US008074714B2

(12) United States Patent
Reid et al.

(10) Patent No.: US 8,074,714 B2
(45) Date of Patent: Dec. 13, 2011

(54) SYSTEM, METHOD AND APPARATUS FOR DOWNHOLE ORIENTATION PROBE SENSOR

(75) Inventors: Leslie C. Reid, Coweta, OK (US); Ralph M. Loveless, Big Cabin, OK (US)

(73) Assignee: Baker Hughes Incorporated, Houston, TX (US)

( * ) Notice: Subject to any disclaimer, the term of this patent is extended or adjusted under 35 U.S.C. 154(b) by 360 days.

(21) Appl. No.: 12/486,289

(22) Filed: Jun. 17, 2009

(65) Prior Publication Data

US 2010/0319911 A1 Dec. 23, 2010

(51) Int. Cl.
*E21B 47/024* (2006.01)

(52) U.S. Cl. ..... 166/255.2; 166/65.1; 166/105

(58) Field of Classification Search ..... 166/105, 166/68, 107, 29, 50, 66, 65.1, 255.2, 255.1; 73/152.61; 417/63
See application file for complete search history.

(56) References Cited

U.S. PATENT DOCUMENTS

| | | | | |
|---|---|---|---|---|
| 2,492,141 | A * | 12/1949 | Gaylord | 310/87 |
| 2,938,090 | A * | 5/1960 | Weber | 200/81 R |
| 2,997,609 | A * | 8/1961 | Lung | 310/87 |
| 3,993,127 | A | 11/1976 | Chepelev et al. | |
| 4,231,252 | A | 11/1980 | Cherkson | |
| 4,434,654 | A | 3/1984 | Hulsing, II et al. | |
| 4,570,709 | A | 2/1986 | Wittrisch | |
| 5,264,795 | A | 11/1993 | Rider | |
| 5,394,941 | A | 3/1995 | Venditto et al. | |
| 5,703,484 | A | 12/1997 | Bieberdorf et al. | |
| 5,850,624 | A | 12/1998 | Gard et al. | |
| 5,880,680 | A | 3/1999 | Wisehart et al. | |
| 6,843,318 | B2 * | 1/2005 | Yarbro | 166/255.2 |
| 7,000,700 | B2 | 2/2006 | Cairns et al. | |
| 7,114,565 | B2 | 10/2006 | Estes et al. | |
| 7,188,671 | B2 | 3/2007 | Al-Zahrani | |
| 7,281,578 | B2 | 10/2007 | Nakajima et al. | |
| 2002/0043372 | A1 | 4/2002 | Cargill et al. | |
| 2005/0115706 | A1 | 6/2005 | Cole et al. | |
| 2009/0084536 | A1 * | 4/2009 | Kenison et al. | 166/66 |

FOREIGN PATENT DOCUMENTS

| | | |
|---|---|---|
| WO | W092/14929 | 9/1992 |

* cited by examiner

*Primary Examiner* — Kenneth L Thompson
(74) *Attorney, Agent, or Firm* — Bracewell & Giuliani LLP

(57) ABSTRACT

A submersible pump assembly may be radially oriented for pumping well fluid in a deviated or horizontal well. The submersible pump assembly has an instrument housing having a longitudinal axis and incorporated onto the pump assembly. An electrical contact is mounted within the housing and an electrical contact probe, moveable relative to the housing and biased upwards toward an upper side of the housing when the pump assembly is inclined, is provided. The housing and the electrical contact are rotatable about the longitudinal axis relative to the electrical contact probe, such that an electrical circuit is completed when the electrical contact is rotated into engagement with the electrical contact probe, generating a signal from the completed electrical circuit. The electrical contact is at a known circumferential position relative to the fixed reference point, which may be the intake port of the pump.

26 Claims, 5 Drawing Sheets

SYSTEM, METHOD AND APPARATUS FOR DOWNHOLE ORIENTATION PROBE SENSOR

FIELD OF THE INVENTION

The present invention relates in general to downhole sensors and, in particular, to an improved system, method and apparatus for a downhole orientation probe sensor, such as for electrical submersible pump applications.

BACKGROUND OF THE INVENTION

Submersible pumping systems, such as electrical submersible pumps (ESP) are often used in hydrocarbon producing wells for pumping fluids from within the well bore to the surface. ESP systems may also be used in subsea applications for transferring fluids, for example, in horizontal conduits or vertical caissons arranged along the sea floor.

Pumps become less efficient when significant amounts of gas from the well fluid flow into the intakes. In a horizontal or highly deviated well, any gas in the well fluid tends to migrate to the upper side of the casing, forming a pocket of free gas. The gas tends to flow into a portion of the intake on the higher side of the pump intake.

Current solutions to this problem include gas restrictors, such as that described in U.S. Pat. No. 6,715,556, and gas separators, such as that described in U.S. Pat. No. 7,270,178. While the prior art types may be workable, they often have multiple moving parts which make them more complicated than necessary, increasing production costs and increasing the likelihood of mechanical failure. Another current prior art alternative would be to drill a sump with multilaterals but this method can add hundreds of thousands of dollars to drilling and production costs.

SUMMARY

Disclosed herein are a system, method, and apparatus for a downhole orientation probe sensor, such as that for electrical submersible pump applications.

The ability to know the radial position or orientation of downhole tools, including Electric Submersible Pumps (ESPs) and attachments or enhancements is of significant value. The term radial position means the particular position that a selected point on the circumference of the ESP is located relative to a true vertical direction while the ESP is in an inclined well, such as a horizontal or highly deviated well. For example, the selected point may be desired to be on the bottom side of the ESP while the ESP is inclined.

Knowing the actual radial position of the tool gives the operator the ability to adjust the equipment by simply rotating the tubing string to the desired position. This ability provides benefits such as the ability to position a pump with a limited number of intake holes in a horizontal well, such that the intake holes are at the bottom for maximum liquid draw. Another benefit is the ability to position the cable or motor lead for minimal stress as it is installed through a deviated well-bore. In this way, downhole equipment could be designed so that the location of the cable or motor lead is optimized and in the case of an ESP with a limited number of intake holes, the position of the intakes relative to the position of the cable or motor lead could be optimized. For example, the intakes could be located circumferentially around only a portion of the pump with the expectation that these intakes be positioned at the bottom of a horizontal well and the cable or motor lead could be positioned circumferentially relative to these intakes so that they are not sandwiched between the pump and the bottom of the horizontal well but are instead placed on top or in the preferred embodiment, placed along the side of the equipment and string in the well.

In addition the ability to radially position downhole equipment could also optimize the installation of various production-aiding devices that enhance production in horizontal or highly deviated wellbores such as a shroud or inverted shroud. For example, the shroud might have a closed base and a closed top with an inlet port on the sidewall of the shroud near the top. Radially orienting the shroud places the inlet port on the bottom side of the shroud. Any aid to increase production from horizontal wells is a significant asset.

Such a downhole sensor comprises a weighted sensor switch which could be included in the module containing other downhole sensors such as ones measuring pressure and temperature. The weighted sensor switch would be employed to give a feedback signal to the surface instruments to indicate the radial position of the downhole equipment, such as the ESP string, or any other tubing string. In practice, as the string is being lowered and when it reaches its final location, the downhole sensor device sends a signal to indicate equipment radial orientation in horizontal or highly deviated wellbores.

According to one aspect of the invention an apparatus for pumping well fluid in a deviated or horizontal well, comprises a submersible pump assembly adapted to be secured to a string of tubing and lowered into a well. An instrument housing having a longitudinal axis is incorporated into the pump assembly. An electrical contact is mounted within the instrument housing. An electrical contact probe, moveable relative to the housing, is biased upwards toward an upper side of the housing when the pump assembly is inclined. The housing and the electrical contact are rotatable about the longitudinal axis relative to the electrical contact probe, such that an electrical circuit is completed when the electrical contact is rotated into engagement with the electrical contact probe. An electrical circuit is completed when the stationary electrical contact contacts the moveable electrical contact probe, such that the position of the fixed reference point relative to a true vertical line can be determined from a signal generated from the completed electrical circuit.

According to another aspect of this invention, an apparatus for pumping well fluid in a deviated or horizontal well, comprises a submersible pump assembly adapted to be secured to a string of tubing and lowered into a well. A cylindrical fluid and gas tight housing is attached to the pump assembly, the housing having a longitudinal axis. An electrical contact ring is mounted to but insulated from an inner surface of the housing. The contact ring has a plurality of electrically conductive segments and encircles the axis of the housing. A fulcrum has an inner end located on the axis and an outer end mounted to the inner surface. A resistor is electrically connected to each conductive segment, each resistor having a unique resistance. A cantilever has an intermediate point pivotally mounted on the inner ends of the fulcrum, the housing being rotatable about the axis relative to the cantilever. An electrically conductive contact probe is situated at one end of the cantilever and a weight is attached to an opposite end of the cantilever. Electrical leads extend from the resistors and from the probe to a power source. The weight causes the contact probe to come into contact with one of the conductive segments to complete an electrical circuit, providing a signal that determines which segment is in contact with the probe.

According to another aspect of this invention, a method for determining the radial orientation of a fixed reference point of an ESP in a deviated or horizontal well, comprises mounting to the ESP a housing having an axis, the housing having an electrical contact offset from the axis of the housing. An electrically conductive probe is pivotally mounted in the housing and biased upward. When the ESP is at the desired depth in an inclined portion of a well, the operator rotates the ESP and the housing about the longitudinal axis while the probe remains stationary, until the electrical contact rotates into engagement with the probe. This contact completes an electrical circuit, passing a current through the completed electrical circuit, and generating a signal by the completed electrical circuit to determine the position of the fixed reference point relative to a true vertical line.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1A:
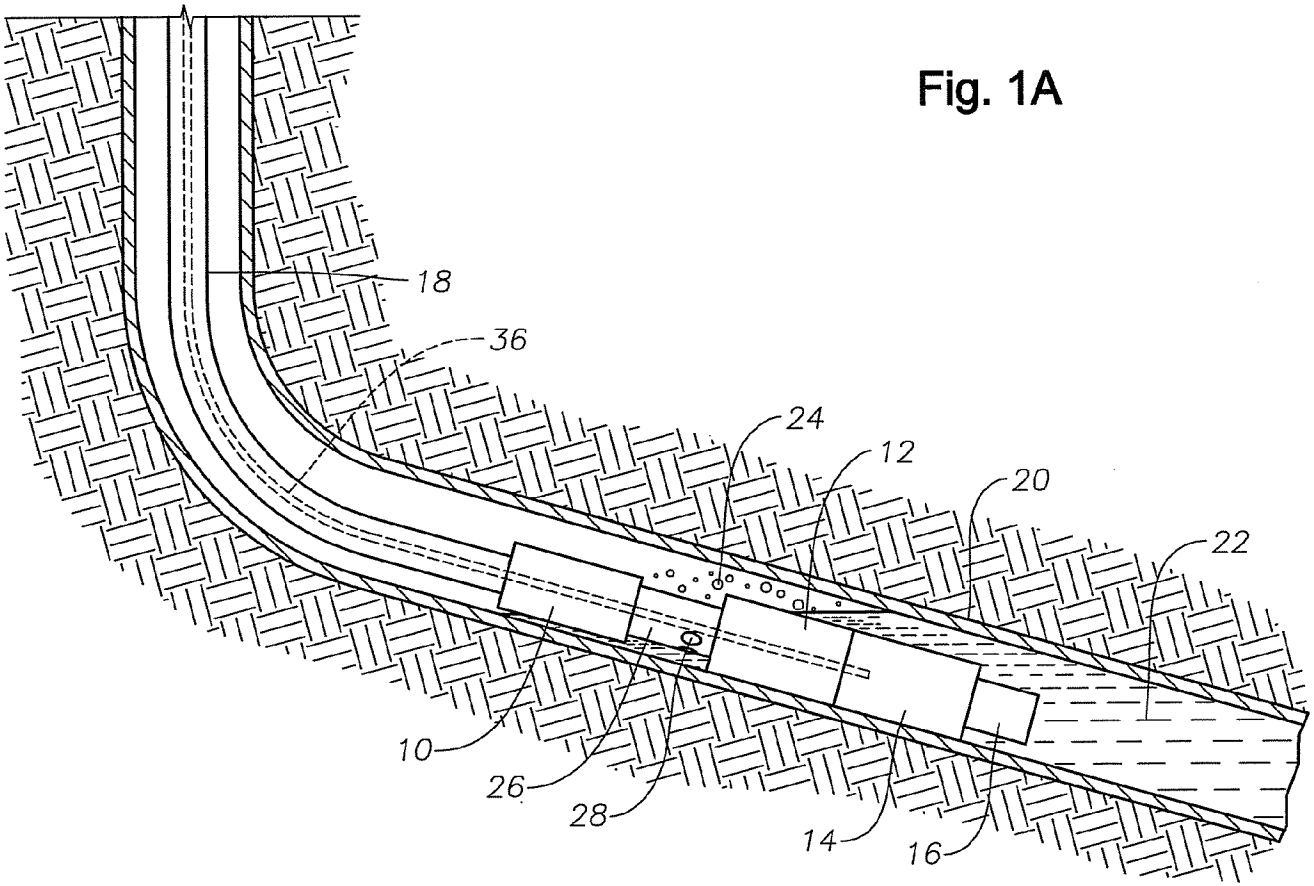
FIG. 1A is a schematic drawing of a deviated well with an ESP and the probe sensor of the present invention.

Referring Initially to FIG. 1A, a pump 10, seal assembly 12, motor 14, and sensors 16 may be suspended from tubing 18 within a wellbore casing 20 that traverses a subterranean formation. In an exemplary embodiment, the casing 20 may be positioned in a highly deviated or horizontal orientation and may contain liquid materials 22 and gaseous materials 24. Thus, due to the relative buoyancy of the gaseous materials 24, in an exemplary embodiment, a lower portion of the casing 20 may contain the liquid materials 22 and an upper portion of the casing may contain the gaseous materials 24. Pump 10 includes an intake portion 26 which may consist of a series of intake ports 28 on a lower portion of the surface of intake portion 26 while pump 10 is oriented horizontally. Preferably there are no intake ports 28 on the upper side of intake portion 26. A motor lead 36 is connected to motor 14 to provide three phase AC power and other signals to motor 14.

Figure 1B:
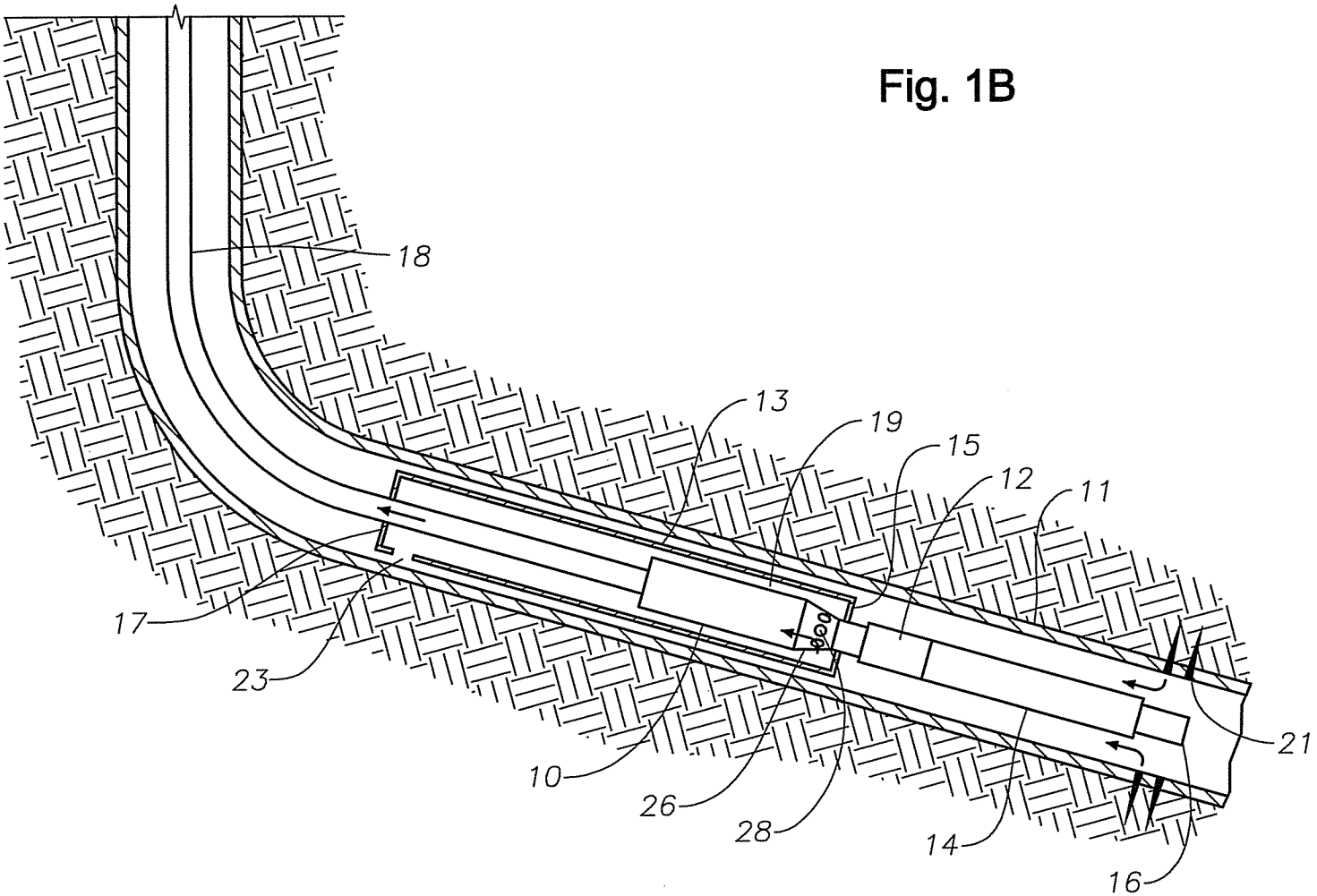
FIG. 1B is a schematic drawing of an alternative embodiment of a deviated well with an ESP and the probe sensor of the present invention.

Referring to FIG. 1B, cased borehole 11 illustrates a typical well having an inlet comprising perforations 21 for the flow of well fluid containing gas and liquid into cased borehole 11. A string of tubing 18 extends downward from the surface for supporting pump 10. A shroud 13 is mounted in an inverted manner in the embodiment of FIG. 1B. Shroud 13 has a closed base end 15 that is secured sealingly around the pump assembly a short distance below pump intake ports 28. Shroud 13 has a closed head end 17 that is located above pump 10 in this example and secured sealingly around tubing 18. Shroud 13 has one or more shroud inlets 23 located near head end 17. When oriented radially and shroud in an inclined position, inlet 23 will be situated along the lower side of shroud 13. The length of shroud 13 depends upon the content of gas in the well fluid, and it could be several hundred feet long. The inner diameter of shroud 13 is larger than the outer diameter of pump 10 in this embodiment, creating a shroud annulus 19 between them.

In the operation of the embodiment illustrated by FIG. 1B, the well fluid flows from perforations 21 past most of the length of shroud 13. At the head end 17 of shroud 13, the well fluid flow changes direction to flow through shroud inlet 23 into shroud annulus 19. When changing direction, some of the gas bubbles in the well fluid, particularly the larger volume gas bubbles, will continue flowing upward in cased borehole 11 for collection at the surface.

Figure 1C:
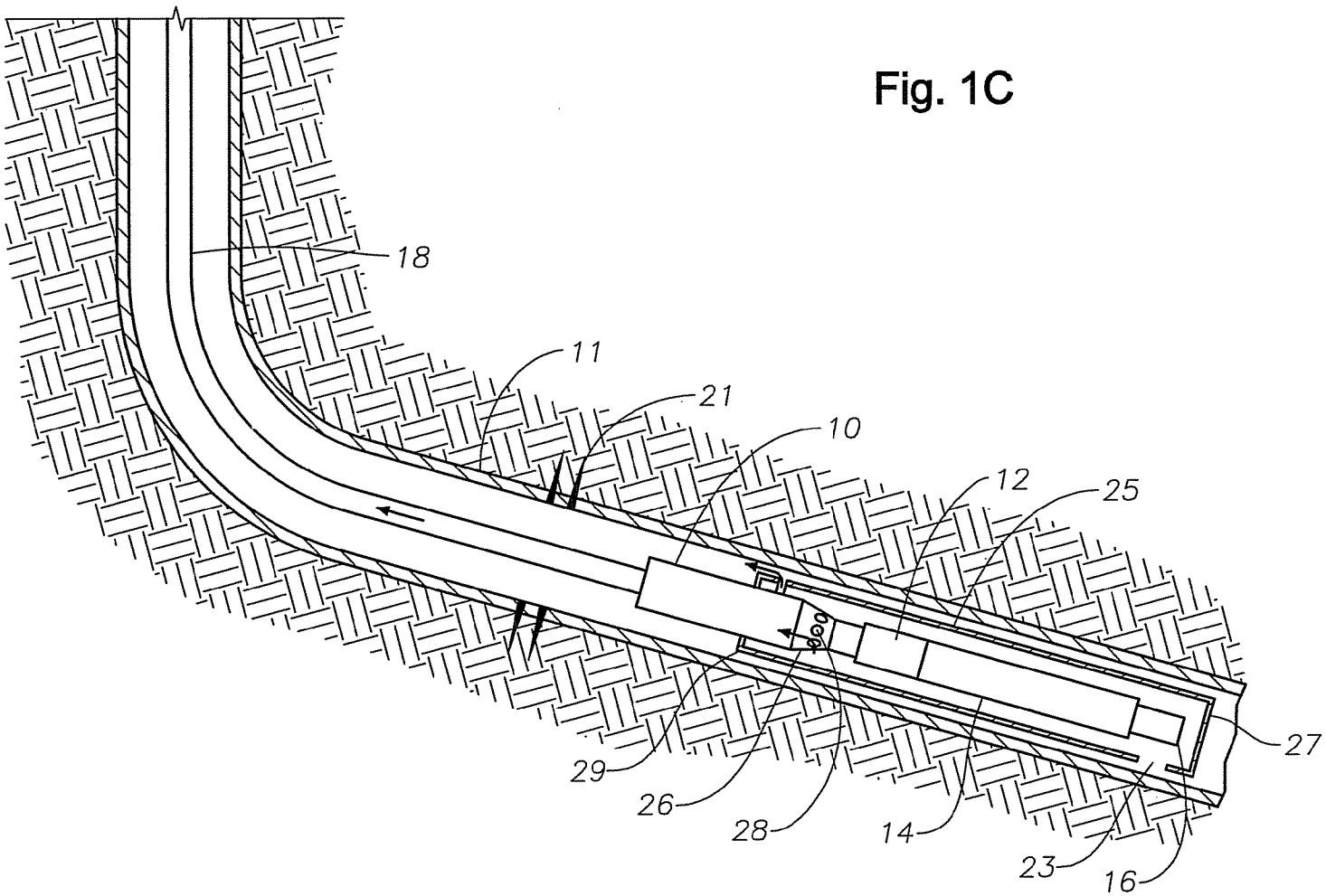
FIG. 1C is a schematic drawing of another alternative embodiment of a deviated well with an ESP and the probe sensor of the present invention.

In the alternate embodiment of FIG. 1C, shroud 25 is mounted over a portion of the pump assembly. In this embodiment, shroud 25 has a closed base end 27 that is located below pump intake ports 28 and a closed head end 29 located above intake ports 28. Closed upper end 29 need be located only a short distance above intake ports 28, but it could be located higher if desired, even above pump 10. Shroud 25 has one or more inlets 23 near base end 27. Preferably, shroud 25 fully encloses motor 14 so that well fluid flowing through inlet 23 of shroud 25 near base end 27 will flow past motor 14 for cooling. Shroud 25 is radially oriented when in an inclined position such that inlet 23 is situated along the lower side of shroud 25.

In the operation of the embodiment of FIG. 1C, well fluid flows from perforations 21 farther into the well, and some gas will separate from the well fluid at perforations 21 due to the buoyant force. The well fluid flows along the casing annulus surrounding shroud 25 and into inlet 23 of shroud 25 near base end 27. The well fluid flows up the interior of shroud 25 into intake ports 28. In the embodiments of FIGS. 1B and 1C, intake ports 28 may be situated all around the surface of intake portion 26 or may only be on a lower portion of the surface of intake portion 26.

Figure 2:
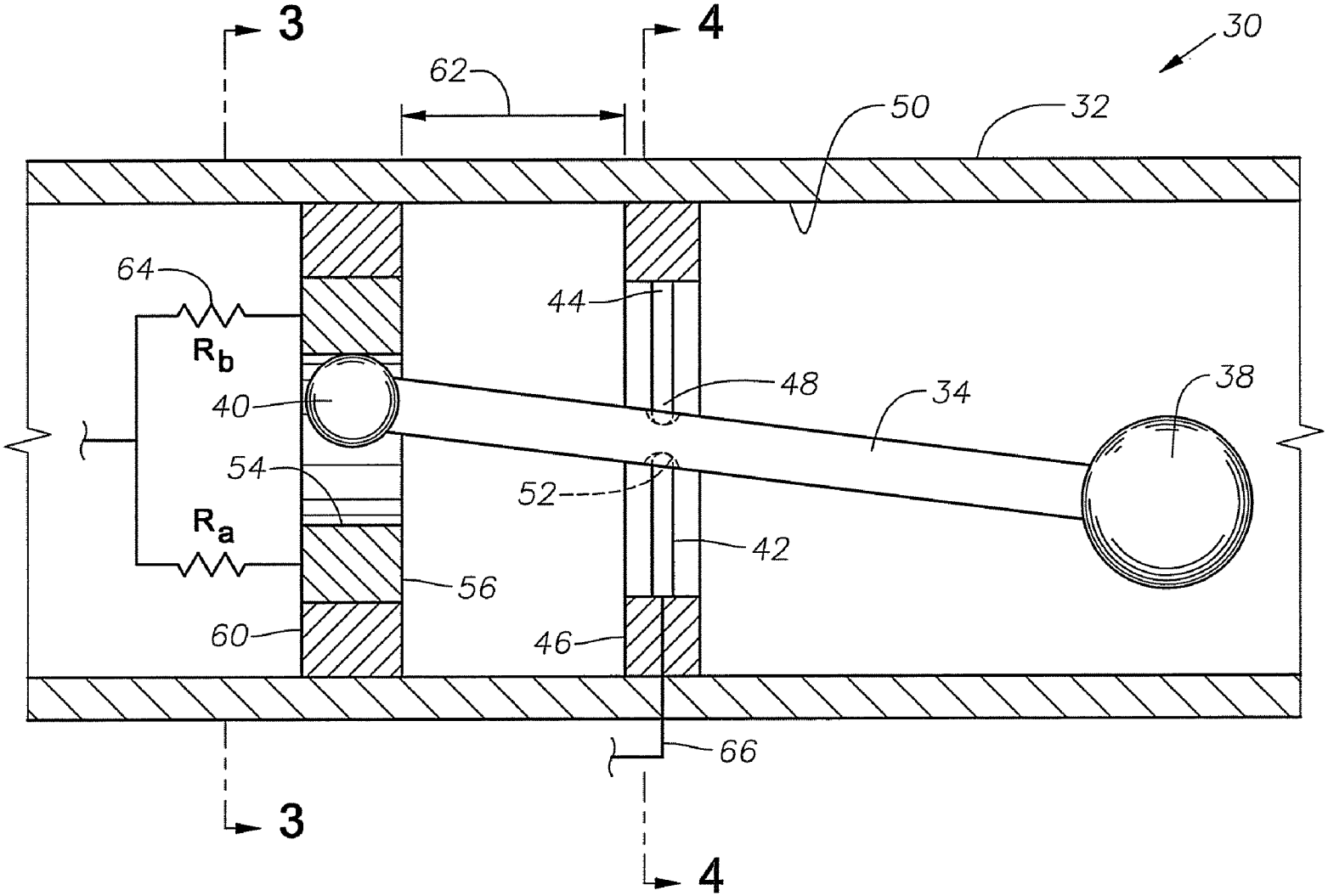
FIG. 2 is a cross-sectional side elevation view of the probe sensor.

Referring next to FIG. 2, the sensors 16 may include a number of sensing devises, including the probe sensor 30 of the current invention as well as pressure and temperature sensors. Sensors 16 are typically powered by rectifying a portion of the AC power supplied down motor lead 36 to motor 14. The components of probe sensor 30 are situated inside a fluid and gas tight sensor housing or shell 32 to protect the components of the probe sensor 30 from the liquid material 22 and gaseous material 24 inside the wellbore casing 20. The components of probe sensor 30 include a long cylindrical cantilever 34. Cantilever 34 has a weight 38 on one end and a contact probe 40 on the opposite end. In the preferred embodiment of FIG. 2, contact probe 40 and weight 38 are both spherical in shape but they may also comprise other convenient shapes such as a box, egg or dome shaped. Contact probe 40 is made of electrically conductive material. A wire extends from contact probe 40 along or within cantilever 34.

Figure 4:
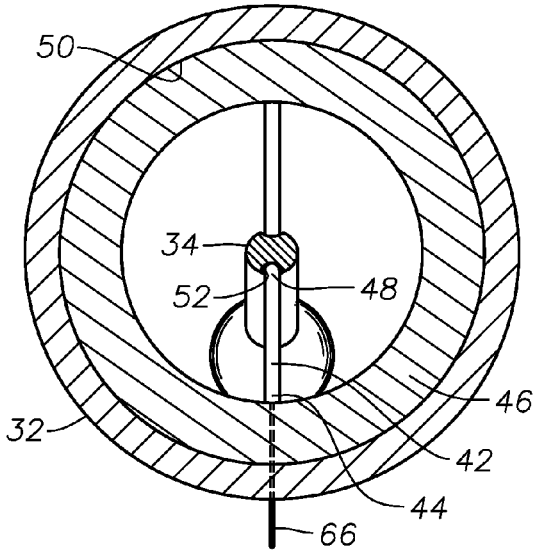
FIG. 4 is a second cross-sectional view perpendicular to the axis of the well at the fulcrum of the present invention.

In the preferred embodiment, a mid-section of cantilever 34 is held in place by at least two fulcrums 42. The outer end 44 of each fulcrum 42 is secured to a first ring shaped electrical insulator 46 which is attached to the inner surface 50 of sensor shell 32. The inner end 48 of each fulcrum 42 is in contact with a mid-section of cantilever 34. As seen in the preferred embodiment of FIG. 2 and FIG. 4, the inner end 48 of each fulcrum 42 is rounded and such rounded inner end 48 is situated within an indent 52 in fulcrum 42. The positioning of inner end 48 within indent 52 allows sufficient freedom of movement so that the contact probe 40 of cantilever 34 is able to rotate a full 360 degrees within the inner circumference 54 of the ring of radial laminations 56 while each fulcrum 42 maintains contact with cantilever 34. Alternative methods of joining the inner end 48 of each fulcrum 42 to cantilever 34 may be employed such as a ball and socket joint. Additionally, alternative means may be used for providing a pivot point for cantilever 34 such as a single fulcrum or 3 or more fulcrums. Alternatively, the two fulcrums could be replaced by a circular disk having a hole in its center and mounted perpendicular to the axis of shell 32.

Figure 3:
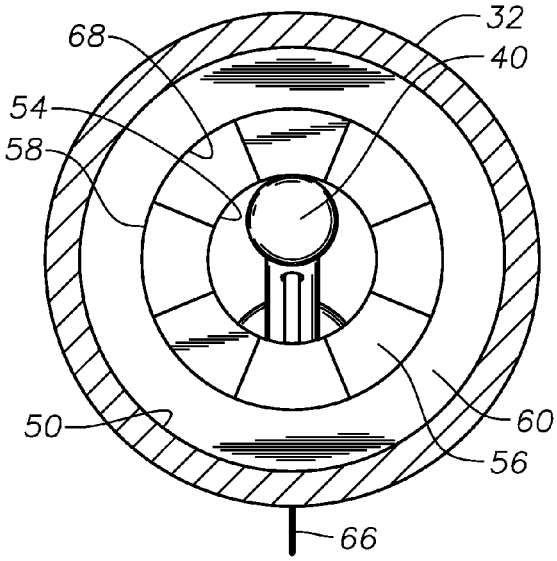
FIG. 3 is a cross-sectional view perpendicular to the axis of the well at the probe sensor of the present invention.

As seen in FIG. 3, in the preferred embodiment, the ring of electrically conductive radial laminations 56, which act as stationary electrical contacts, comprise a series of segments or laminations which together form a ring. The outer surface 58 of such ring of laminations 56 is in contact with an inner surface 68 of a second ring shaped electrical insulator 60, which is attached to the inner surface 50 of sensor shell 32 at an axial distance 62 from the first insulator 46. Returning to FIG. 2, in the preferred embodiment, each segment of laminations 56 is connected to a resistor 64, each resistor having a unique resistance. Each lamination segment 56 is spaced apart from adjacent segments 56 by clearances or insulators. Each resistor 64 is connected to a resistor lead 66 which in turn is connected to one of the fulcrums 42. When probe 40 touches any of the laminations 56, an electrical circuit is completed.

The route of the circuit in the preferred embodiment of FIG. 2 is from the contact probe 40, through the lamination 56 to resistor 64, to resistor lead 66 through fulcrum 42 to the cantilever 34 to return to the contact probe 40. The source of power (not shown) for the circuit may be from motor 14 (FIG. 1) and may be connected to the resistor or the fulcrum or any other place within the circuit which is convenient. Because each resistor 64 has a unique resistance, by passing a current through the circuit from a known voltage and measuring the current or the change in voltage, the resistor, which is part of the circuit, can be identified and the radial orientation of the probe sensor 30 can be determined. The width of probe 40 and spacing of the lamination segments 56 are such that electrical contact is made between probe 40 and one or two distinct lamination segments 56 at any one time. The resistance of each of the resistors 64 is such that if probe 40 contacts two lamination segments 56 at the same time, the total resistance measured would be distinct and observable so as to deduce the exact position of probe 40.

Alternatively, the resistors 64 may not be necessary where an alternative means of measurement over a completed electrical circuit may be used such as different or unique power frequencies supplied to each segment of laminations. In an alternative embodiment, a single electrically conductive radial lamination may be provided and located in such a position within the probe that the circuit will only be completed when the optimal orientation of the downhole equipment is achieved.

The transmission of the signal from the sensor to the surface can be achieved by imposing the signal on motor lead 36 and the power cable leading to the surface. Alternatively, the signal may be transmitted by remote signal, or by any other means known in the art. After the radial orientation of the equipments has been determined, the operator can rotate the tubing 18, causing the pump 10, intake 26 and motor 14 to rotate until the optimal radial orientation of the equipment is achieved.

In operation, shell 32 is attached to motor 14 in a radial orientation that causes probe 40 to contact a selected one of the laminations 56 while the pump assembly is horizontal or inclined. The particular resistor 64 for that lamination 56, referenced herein as the reference resistor 64, will be on the uppermost point of shell 32 while a reference point on the pump assembly is spaced a desired circumferential distance away from the lamination 56 for reference resistor 64. For example, in the embodiment of FIG. 1A, the reference point comprises intake port 28, the center of which will be spaced relative to the longitudinal axis 180 degrees away from the lamination 56 for reference resistor 64. The resistance of the reference resistor 64 is known. Being 180 degrees away, the center of intake port 28 and the center of the lamination 56 for reference resistor 64 will be in the same plane that contains the longitudinal axis of the pump assembly. When the pump assembly is inclined with intake port 28 on the lowermost side and lamination 56 for reference resistor 64 on the uppermost side, this plane will be in a true vertical orientation.

The operator runs the pump assembly into the well on a string of tubing 18. When the pump assembly is at a desired depth, it will be inclined or horizontal. As shown in FIG. 2, weight 38 at one end of fulcrum 42 will be pulled downwards due to the force of gravity, causing contact probe 40 to rise and come into contact with one of the radial laminations 56, completing an electrical circuit. The operator detects the signal caused by the completed circuit, which determines whether the reference resistor 64 is at the uppermost side of shell 32. If not, the operator rotates tubing 18, which causes the pump assembly and shell 32 to rotate. Contact probe 40 does not rotate with shell 32, rather touches each lamination 56 as such laminations rotate past. A different signal is sent as probe 40 touches each lamination 56. When the reference resistor 64 is touching probe 40, the signal will inform the operator that the reference resistor 64 is now on the uppermost side of the pump assembly and the intake port 28 on the lower side relative to true vertical. For certain wells, such as those producing liquid and gas, locating the intake port 28 in the bottom rather than the top is preferred. This position reduces gas flow into pump 10.

Figure 5:
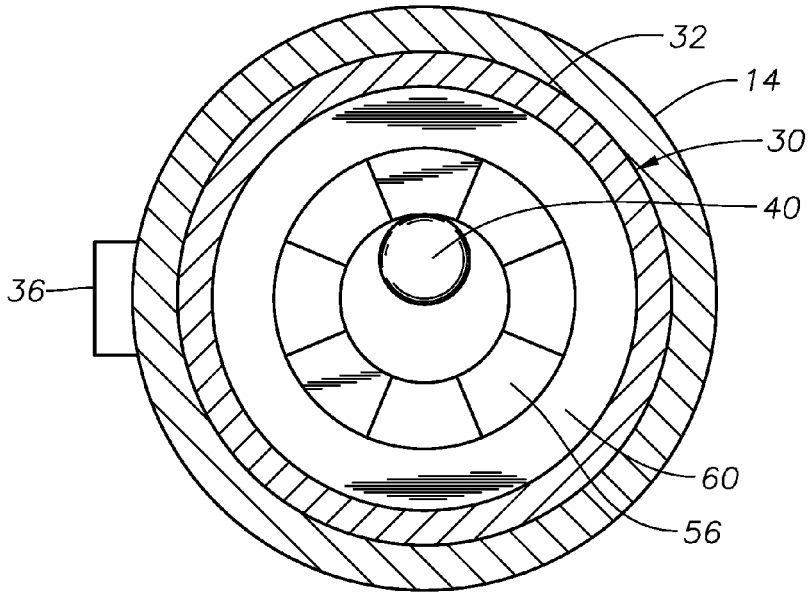
FIG. 5 is a schematic cross-sectional view of the probe sensor and ESP of the present invention.

Rather than spacing lamination 56 for the reference resistor 64 relative to intake port 28, the operator may space lamination 56 for the reference resistor 64 a selected number of degrees from a reference point that is where motor lead 36 joins motor 14. Preferably, once the pump assembly is radially oriented in an inclined part of the well, motor lead 36 will be at a position other than on the bottom of the pump assembly and pushed into contact with casing 20 by the weight of the pump assembly. For example, motor lead 36 could join motor 14 at a point between 90 to 180 degrees away from the lamination 56 of reference resistor 64. This would place motor lead 36 equal to or above the longitudinal axis of the pump assembly when the lamination 56 for the reference resistor 64 is at its uppermost point when the pump assembly horizontal. FIG. 1A and FIG 5 shows motor lead 36 at about 90 degrees relative to the lowermost side and uppermost side of the pump assembly. As seen in FIG 5, which schematically illustrates the relative position of probe 40 of sensor 30 relative to the motor lead 36, of the pump assembly, when motor lead 36 is at about 90 degrees relative to the lowermost side and uppermost side of the pump assembly, motor lead 36 at an equal elevation with the longitudinal axis of motor 14 of the pump assembly. In practice, the operator would install the pump assembly into the well and just after the unit has started to angle toward the horizontal, the operator would stop the installation and check the orientation of motor lead 36 by using process described above. Adjustments to the orientation of motor lead 36, if required, can be made then installation would resume until the pump assembly has landed at the final location. Periodic checks could be made as the pump assembly passes through the deviation.

Referring to FIGS. 1B and 1C, the operator may space lamination 56 for reference resistor 64 approximately 180 degrees from shroud inlet 23 relative to the longitudinal axis of the pump assembly. When inclined and the lamination 56 for reference resistor 64 on the uppermost side of the pump assembly, shroud inlet 23 will be on the lower side of the pump assembly.

While the invention has been shown or described in only some of its forms, it should be apparent to those skilled in the art that it is not so limited, but is susceptible to various changes without departing from the scope of the invention. For example, weight 38 on the end of cantilever 34 could serve as an electrical conductor, allowing electrical conductor 40 to be eliminated. In that event, laminations 56 would be placed so as to be contacted by weight 40, and the intake 28 or shroud inlet 23 could be circumferentially aligned with each other, rather than 180 degrees apart. The center of the lamination 56 for the reference resistor 64 would still be in the same vertical plane with the center of the reference point, whether it is intake 28 or shroud 23. Also, it is not necessary that the lamination for the reference resistor and the particular reference point be in the same vertical plane as long as the circumferential degree spacing apart from each other is known.

The invention claimed is:

1. An apparatus for pumping well fluid in a deviated or horizontal well, comprising:

a submersible pump assembly adapted to be secured to a string of tubing and lowered into a well;

an instrument housing having a longitudinal axis and incorporated into the pump assembly;

an electrical contact mounted within the housing;

an electrical contact probe, moveable relative to the housing and biased by gravity toward one side of the housing when the pump assembly is inclined; and the housing and the electrical contact being rotatable about the longitudinal axis relative to the electrical contact probe, such that an electrical circuit is completed when the electrical contact is rotated into engagement with the electrical contact probe, generating a signal from the completed electrical circuit.

2. The apparatus of claim 1 wherein the electrical contact is mounted to an interior side wall of the housing so that it moves in a circular path as the housing is rotated.

3. The apparatus of claim 1 further comprising a plurality of additional electrical contacts mounted in an annular array around an interior side wall of the housing and wherein the electrical contact probe sequentially engages each of the electrical contacts as the housing is rotated about the axis.

4. The apparatus of claim 3 further comprising a resistor with a unique resistance attached to each of the electrical contacts, and whereby the signal generated from the completed circuit identifies which resistor is part of the completed circuit.

5. The apparatus of claim 1 wherein one end of a cantilever is attached to the electrical contact probe, and wherein the cantilever is pivotally supported within the housing so that the electrical contact is biased by gravity toward said one side of the housing.

6. The apparatus of claim 1 wherein when the pump assembly is oriented in an inclined position and an intake of the pump assembly is on a lower side of the pump assembly, the electrical contact will be located in a same vertical plane as the intake.

7. The apparatus of claim 1 further comprising:

a shroud surrounding the pump assembly defining an annulus between the pump assembly and the shroud, the shroud having a sealed head end and a sealed base end and an inlet in a sidewall of the shroud; and wherein the inlet in the shroud is located on a lower side of the shroud when the signal is generated.

8. The apparatus of claim 1 further comprising:

a motor lead connected to a motor of the pump assembly extending along a side of the pump assembly; and wherein a point where the motor lead connects to the pump assembly is located at or above the elevation of the longitudinal axis when the signal is generated.

9. An apparatus for pumping well fluid in a deviated or horizontal well, comprising:

a submersible pump assembly adapted to be secured to a string of tubing and lowered into a well;

a cylindrical fluid and gas tight housing attached to the pump assembly, the housing having a longitudinal axis;

an electrical contact ring mounted to but insulated from an inner surface of the housing, having a plurality of electrically conductive segments, the contact ring encircling the axis of the housing;

a resistor electrically connected to each conductive segment, at least one of the resistors, designated a reference resistor, having a unique resistance from the other resistors;

a cantilever pivotally mounted within the housing, the housing being rotatable about the axis relative to the cantilever;

an electrically conductive contact probe situated at one end of the cantilever and biased by gravity into contact with the conductive segments;

electrical leads extending from the resistors and from the probe to a power source; whereby when the pump assembly is inclined and the housing rotated, gravity causes the contact probe to come into contact with one each of the conductive segments to complete an electrical circuit and provide a signal that determines when the contact probe has contacted the segment connected to the reference resistor.

10. The apparatus of claim 9 further comprising:

a fulcrum mounted in the housing and having an inner end; and wherein the cantilever is pivotally mounted to the fulcrum; and a weight is attached to an end of the cantilever on an opposite side of the fulcrum from the contact probe.

11. The apparatus of claim 10 wherein the fulcrum consists of two linear members, each situated on a radial line relative to the axis of the housing.

12. The apparatus of claim 9 wherein an insulator ring is located between the contact ring and the inner surface of the housing.

13. The apparatus of claim 9 wherein when the pump assembly is horizontal and an intake is on a lower side of the pump assembly, the conductive segment connected to the reference resistor will be at an uppermost point of the housing.

14. The apparatus of claim 9 wherein the conductive segments are electrically insulated from each other.

15. The apparatus of claim 9 further comprising a motor power cable extending from the surface to a motor, and the power source is supplied though the power cable and the signal sent back through the power cable.

16. The apparatus of claim 15 wherein when the pump assembly is in an inclined position and a point where the motor power cable connects to the motor is other than on a lower side of the pump assembly, the signal will be made, the contact probe will be in contact with the conductive segment attached to the reference resistor.

17. The apparatus of claim 9 further comprising:

a shroud surrounding the pump assembly defining an annulus between the pump assembly and the shroud, the shroud having a sealed head end and a sealed base end;

an inlet in a sidewall of the shroud that is at a known circumferential point relative to the conductive segment connected to the reference resistor; and wherein the inlet is located on a lower side of the shroud when the pump assembly is inclined and when the contact probe is in contact with the conductive segment connected to the reference resistor.

18. A method for determining the radial orientation of a fixed reference point of an ESP in a deviated or horizontal well, comprising:

(a) mounting to the ESP a housing having an axis, an electrical contact in the housing offset from the axis and circumferentially oriented relative to the fixed reference point, and an electrically conductive probe that is pivotally mounted in the housing and biased by gravity toward a sidewall of the housing;

(b) lowering the ESP into an inclined portion of a well;

(c) when at a desired depth, rotating the ESP and the housing and the electrical contact about the longitudinal axis while the probe remains stationary, until the electrical contact rotates into engagement with the probe, completing an electrical circuit; and (d) generating a signal by the completed electrical circuit to determine the position of the fixed reference point relative to true vertical in the wellbore.

19. The method of claim 18 wherein step (b) comprises lowering the ESP on a string of tubing and step (c) comprises rotating the tubing to rotate the ESP.

20. The method of claim 18 wherein step (a) comprises connecting a resistor to the electrical contact and step (d) comprises passing current through the resistor with a fixed voltage.

21. The method of claim 18 wherein step (a) comprises mounting a plurality of electrical contacts in an annular array surrounding the axis, each of the electrical contacts having a unique electrical characteristic so that if engaged by the probe in step (c), a unique signal is generated in step (d).

22. The method of claim 21 wherein the unique characteristic comprises electrical resistance.

23. The method of claim 18 wherein in step (a), the electrical contact is mounted 180 degrees from the fixed reference point.

24. The method of claim 23 wherein the fixed reference point comprises an intake of the ESP.

25. The method of claim 23 wherein step (a) further comprises mounting a shroud to the ESP defining an annulus between the ESP and the shroud, the shroud having a sealed upper end and a sealed bottom end and an inlet located near the bottom end of the shroud and wherein the fixed reference point comprises the inlet.

26. The method of claim 18 wherein in step (a), the reference point comprises a motor lead attachment point.

* * * * *